US007676177B2

(12) United States Patent
Elliot et al.

(10) Patent No.: US 7,676,177 B2
(45) Date of Patent: Mar. 9, 2010

(54) BRICK-BASED SYSTEM FOR SCHEDULING FUNCTIONS IN A PRINTING APPARATUS

(75) Inventors: Michael W. Elliot, Macedon, NY (US); Marc Palmaffy, Sahuarita, AZ (US); Michael J. Dahrea, Rochester, NY (US); Stephen F. Randall, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 198 days.

(21) Appl. No.: 11/805,461

(22) Filed: May 23, 2007

(65) Prior Publication Data

US 2008/0292350 A1 Nov. 27, 2008

(51) Int. Cl.
*G03G 21/00* (2006.01)

(52) U.S. Cl. ..... 399/160; 399/72

(58) Field of Classification Search ..... 399/46, 399/49, 72, 160, 301

See application file for complete search history.

(56) References Cited

U.S. PATENT DOCUMENTS 5,173,733 A 12/1992 Green
6,167,217 A 12/2000 Kelsch et al.
6,385,408 B1 5/2002 Scheuer
6,804,485 B2 * 10/2004 Martin et al. ..... 399/159
7,280,792 B2 * 10/2007 Sawai et al. ..... 399/303
2007/0286620 A1 * 12/2007 Kitamura ..... 399/49

OTHER PUBLICATIONS

U.S. Appl. No. 11/517,163, filed Sep. 7, 2006 Scheduling System for Placing Testpatches in a Printing Apparatus.

* cited by examiner

*Primary Examiner*—David M Gray
*Assistant Examiner*—Gregory H Curran
(74) *Attorney, Agent, or Firm*—Matthew C. Loppnow; Prass LLP

(57) ABSTRACT

In a printing apparatus having a rotatable imaging member and means for performing a selected one of a plurality of operations on a portion of the rotatable imaging member, a set of metaphorical bricks are used to schedule operations. For an operation of a first type, a first brick is scheduled, the first brick defining a time duration associated with the operation, and defining a first portion having a first height and a second portion having a second height. For an operation of a second type, a second brick is scheduled, the second brick defining at least one height and a time duration associated with the operation. A combined height of bricks scheduled over time is monitored.

7 Claims, 3 Drawing Sheets

BRICK-BASED SYSTEM FOR SCHEDULING FUNCTIONS IN A PRINTING APPARATUS

CROSS-REFERENCE TO RELATED APPLICATION

Cross-reference is hereby made to the following patent application: SCHEDULING SYSTEM FOR PLACING TEST PATCHES IN A PRINTING APPARATUS, U.S. patent application Ser. No. 11/517,163, filed Sep. 7, 2006, and assigned to the assignee hereof.

TECHNICAL FIELD

The present disclosure relates to digital printing systems, such as those using xerography.

BACKGROUND

Many printing technologies, such as xerography and ink-jet printing, exploit a rotatable imaging member on which an image is first created with marking material, such as liquid ink or powdered toner, and then transferred to a print sheet. When controlling such a printing apparatus, it is common to place on the imaging member at various times test patches, meaning areas of marking material of predetermined desired properties such as optical density, and then measuring the actual properties of each test patch as part of an overall control process.

In some embodiments of printing apparatus, the test patches are placed on the imaging member, and tested for certain properties; but the marking material forming each test patch is never transferred to a print sheet. In such cases, the marking material forming the test patches has to be cleaned off, such as by a cleaning device within the apparatus. In some situations, the imaging member has to cycle multiple times past the cleaning device to remove the marking material sufficiently from the patch area. On the intermediate cycles before the marking material on the test patch is completely removed, the area around the test patch cannot be used for placing of images.

U.S. Pat. Nos. 6,167,217 and 6,385,408 disclose basic systems for scheduling the creation of test patches in a xerographic printer. U.S. Pat. No. 5,173,733 shows a system for disabling page-sized areas on a photoreceptor in response to detecting imperfections on the photoreceptor.

SUMMARY

According to one embodiment, there is provided a method of operating a printing apparatus, the apparatus having a rotatable imaging member, and means for performing a selected one of a plurality of operations on a portion of the rotatable imaging member. In time space, for an operation of a first type, a first brick is scheduled, the first brick defining a time duration associated with the operation, and defining a first portion having a first magnitude and a second portion having a second magnitude. In time space, for an operation of a second type, a second brick is scheduled, the second brick defining at least one magnitude and a time duration associated with the operation. A combined magnitude of bricks scheduled over time is monitored.

DETAILED DESCRIPTION

Figure 1:
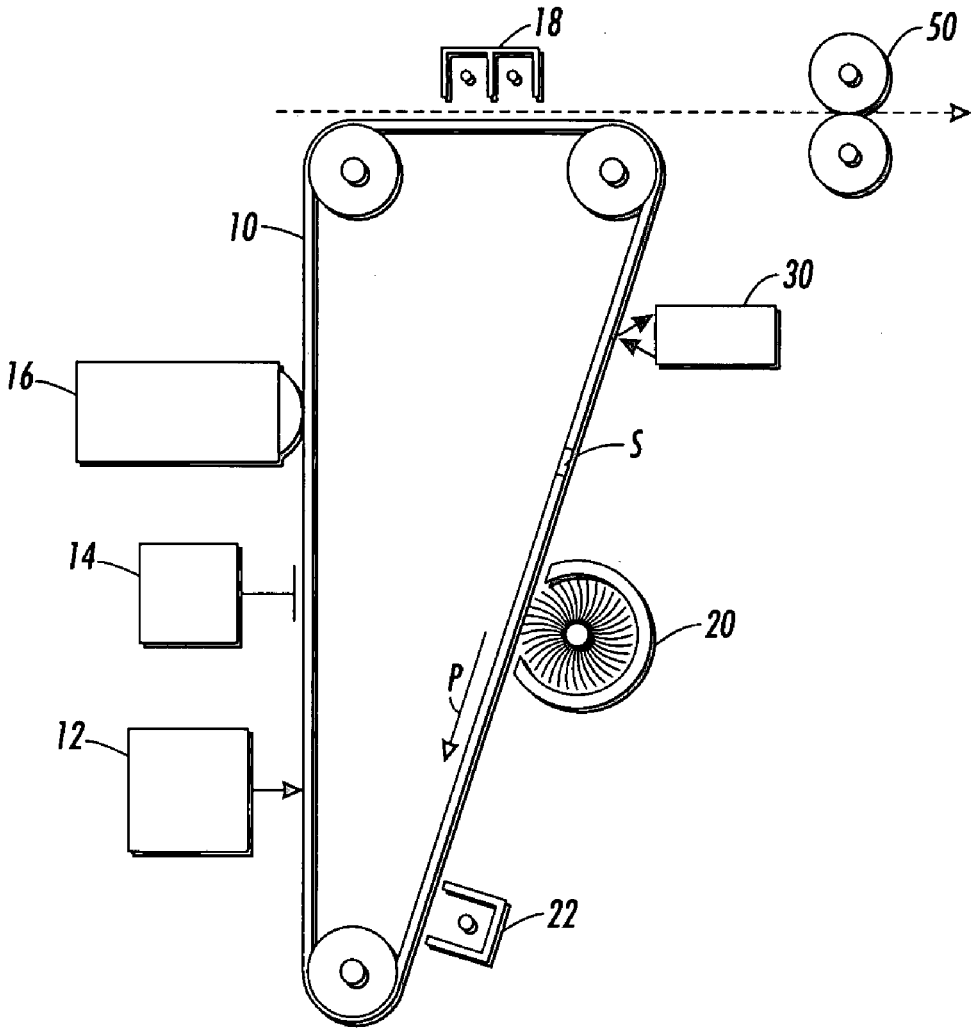
FIG. 1 (PRIOR ART)
FIG. 1 is a simplified elevational view of the basic elements of a xerographic printer.

FIG. 1 is a simplified elevational view of the basic elements of a xerographic laser printer, as is generally familiar in the art. Although a monochrome, xerographic printing apparatus with a photoreceptor belt is shown and described in the present embodiment, the claimed invention can be applied to other printing technologies, such as ink-jet or offset, and can be applied to any color apparatus in which multiple color separations are built up in one or more cycles on a rotatable image member to form a full-color image.

In the FIG. 1 embodiment, a rotatable imaging member is in the form of a belt photoreceptor 10 (although other types of imaging member are applicable, such as in other printing architectures and technologies). The photoreceptor 10 rotates along a process direction P. With regard to any small area on the outside surface of photoreceptor 10, the area is first initially charged by a charging device 22. An electrostatic latent image, based on an image desired to be printed, is created by using a laser 12 to discharge certain areas of the photoreceptor surface. (Broadly speaking, the laser 12 and its ancillary optical elements form an imaging station; other types of imaging station could include an ink-jet printhead, an ionographic printhead, a photoreceptor from which an image is transferred to an intermediate belt, or any other device that causes a desired image or latent image to be placed on the rotatable imaging member.) In certain types of printing systems, the condition of the photoreceptor after image exposure can be monitored by a sensor 14, which is typically in the form of an electrostatic voltmeter or an optically-based sensor. The suitably-charged areas are then developed with developer unit 16, which in this case places toner particles in imagewise fashion on the surface of photoreceptor 10. The toner, or more broadly marking material, is then transferred to a print sheet (not shown) at a transfer station 18. Any residual toner remaining on the photoreceptor 10 after image transfer is cleaned by a cleaning device 20, so that the photoreceptor surface can be recharged at charging station 22 to receive another image. The print sheet is then sent through a fuser 50, in a manner familiar in the art.

At times when it desired to place a test patch on the surface of photoreceptor 10, the laser 12 is used to place a latent image on the photoreceptor, such that, when the latent image is developed with developer unit 16, a test patch of desired properties (such as optical density) results. In the FIG. 1 embodiment, the developed test patch is then monitored for density by a test patch monitor 30, seen here downstream of the transfer station 18. As mentioned above, when test patches are deployed, the marking material for the patches is typically not transferred to a print sheet at transfer station 18, and so a relatively large quantity of marking material must be removed by cleaning station 20. In many cases, the photoreceptor 10 must cycle the test patch multiple times (typically two or three times) past cleaning device 20 to remove all the marking material, so that the area can be used for placing an image thereon. Also, it would not be desirable to place a subsequent test patch in the same place as an imperfectly removed previous test patch, as the residual marking material would adversely affect the testing of the new test patch.

Figure 2:
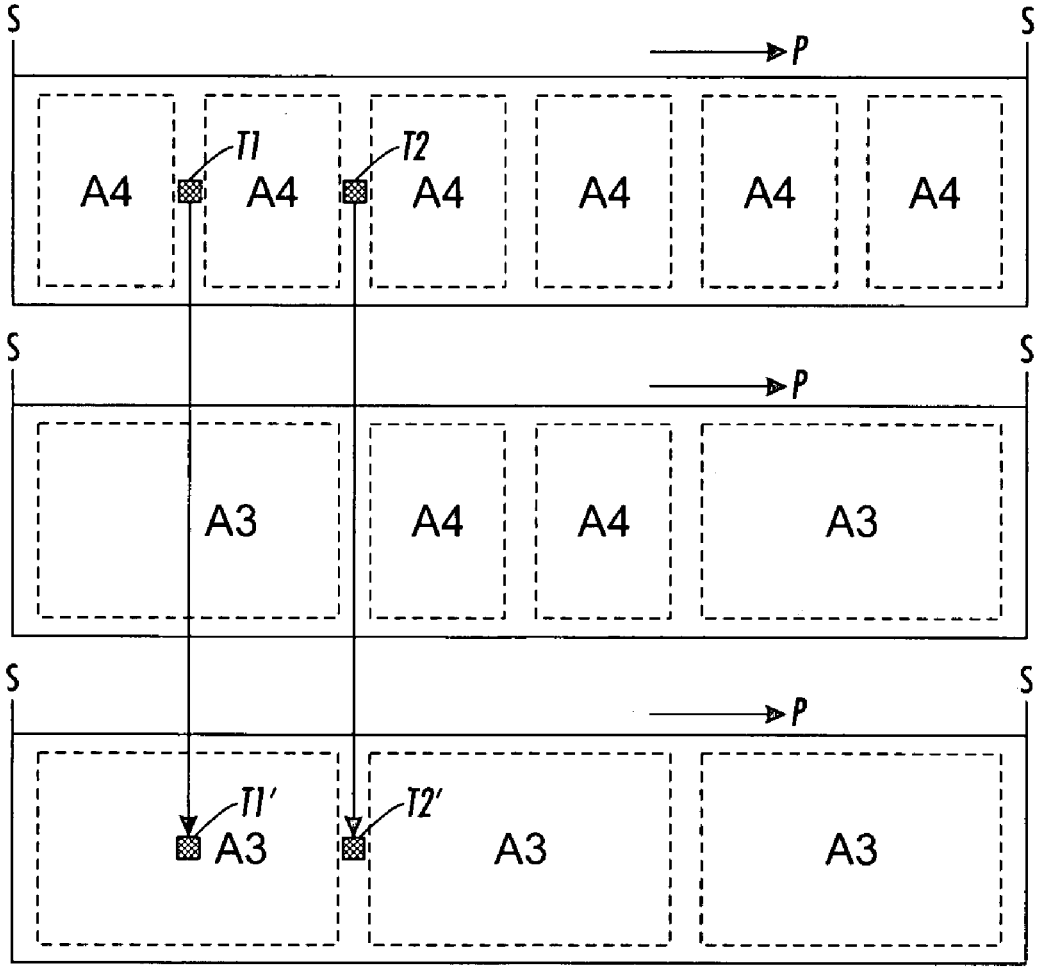
FIG. 2 is a plan view of a belt photoreceptor flattened out over three rotations thereof.

FIG. 2 is a plan view of the photoreceptor 10 flattened out over three rotations thereof according to one embodiment. In the following discussion, it will be assumed that the apparatus is designed to create, as needed, either one pitch (letter or A4) or two pitch (11×17 inch or A3) images, although other image sizes would be possible in other practical embodiments. As shown, the two ends of the photoreceptor 10 are marked by a seam S, which is also shown in FIG. 1. In the embodiment, each rotation of the photoreceptor belt 10 accommodates six one-pitch images, indicated as A4 for convenience; three two-pitch images, indicated as A3 for convenience; or some combination of one-pitch and two-pitch images within each rotation as desired and as physically possible.

Test patches are placed at various locations in interdocument zones between image areas, typically some predetermined safe distance from areas where an image would be placed, so that marking material from the test patches would not accidentally be transferred to a print sheet as part of an image to be printed. Taking the example of a test patch T1 placed as shown, and assuming there must be three rotations of photoreceptor 10 before the patch T1 is fully erased, it can be seen that, once the test patch T1 is placed, the area on which the patch has been placed is precluded from receiving an A3 image two rotations in the future, as shown by the patch T1', which is the same patch T1, only two rotations later, and not completely erased. However, a patch such as shown at T2, which two rotations later would be disposed between two A3 image areas, would be allowable. Of course, one way to ascertain whether the placement of a patch at T2 would be allowable is to populate a future time-frame of images to be printed, and see what gaps are available.

The scenario of FIG. 2 presumes that a test patch such as T1 or T2 placed initially on a predetermined area of photoreceptor 10 will survive at least two passes through the cleaning station 20 such as shown in FIG. 1. In other words, cleaning station 20 is of such an effectiveness that typically three passes through the cleaning station are required to remove effectively all of a test patch before further marking material, either as part of an image to be printed or another test patch. However, in a practical situation, given various real-world conditions at a given time, all of the marking material associated with a test patch may be removed in fewer than a baseline number of rotations of the patch past cleaning station 20. The sensor 14 and/or test patch monitor 30 can be used for real-time measurement of a patch such as T1, for multiple rotations immediately after the creation of a test patch by laser 12 and developer unit 16. With each rotation of a test patch through cleaning station 20, the erasure of the test patch can thus be monitored as it approaches effective completion and the area can be made available for further imaging.

Figure 3:
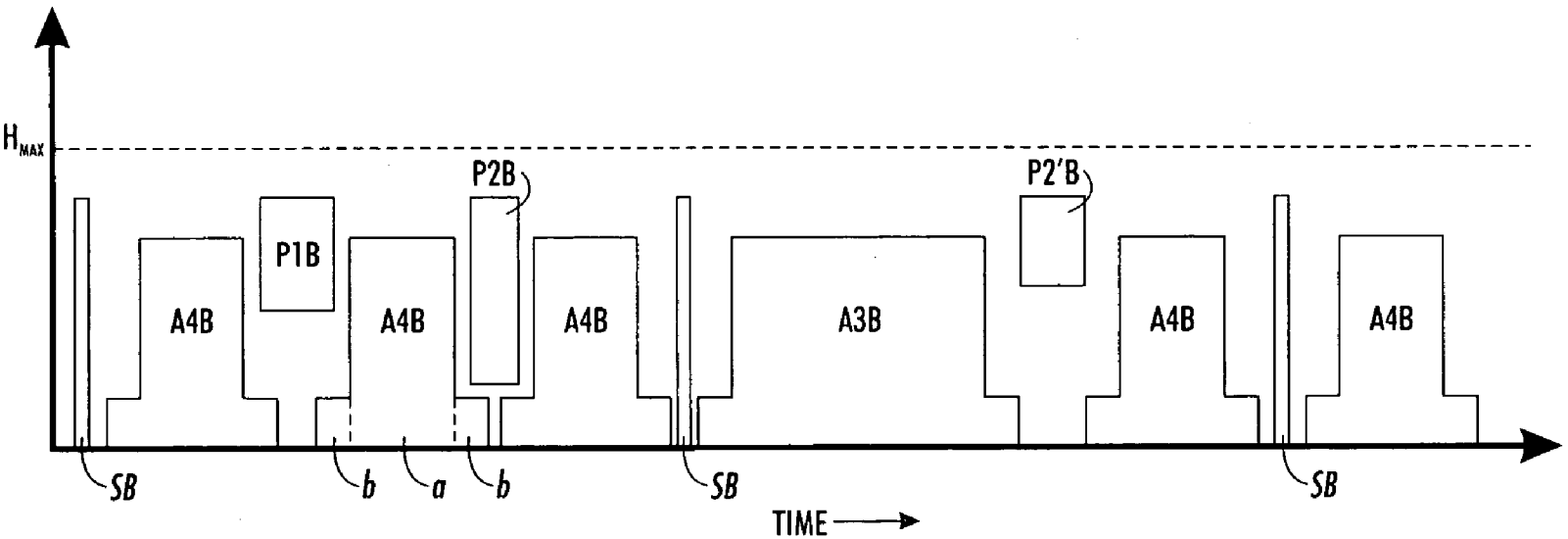
FIG. 3 is a diagram of an operation schedule for a printer, populated by bricks corresponding to possible actions of the printer.

FIG. 3 is a diagram of a time frame illustrating principles of scheduling image and test patch placement over time according to another embodiment. In the diagram, the X-axis represents time over two revolutions of the photoreceptor 10 (i.e., to schedule machine activities for two photoreceptor rotations in the future), and the Y-axis represents what will be called metaphorically a height, or more generally a magnitude, of one or more actions to be performed relative to the photoreceptor 10 at various points in time.

According to the present embodiment, each of various possible actions that can be carried out on a portion of photoreceptor 10 is assigned a height: once again, this term is used only metaphorically. The height of an action, or portion of an action, is spread along the necessary time duration of the action, or portion of the action, forming what is here metaphorically called a brick. A plurality of actions can be carried out on a portion of the photoreceptor 10 at a given time, but the heights of each action are added up, or otherwise combined, at the given time, and the total combined height of the actions at the given time must be less than a predetermined maximum height. The use of bricks for action scheduling in the time domain is roughly reminiscent of the computer game TETRIS™, in that actions, symbolized by bricks simulating physical properties, must be fit efficiently into a given symbolic space.

Looking at FIG. 3 in detail (the bricks of which do not correspond to the actions of FIG. 2), there can be seen, through time, a series of bricks, each brick representing an assigned height or magnitude (the Y-axis) of an action or other constraint over a time duration (the X-axis). For instance, the bricks marked A4B represent placement of an A4 or letter sized image on the photoreceptor 10, and the brick marked A3B represents placement of an A3 image on the photoreceptor 10. Other types of bricks shown include seam bricks SB, corresponding to the presence of the seam in the photoreceptor belt adjacent to the imaging station; a patch brick of a first type P1B, which can be erased after one rotation, corresponding to the placement of one type of patch on the photoreceptor; and a patch brick of a second type P2B, along with what can be called an erase brick P2'B, corresponding respectively to placement of a patch of a second type and the remainder of the patch after it has been partially erased in a subsequent rotation of the photoreceptor. It will be noticed that, in this embodiment, the erase brick P2'B has a smaller height than the patch brick P2B.

Each type of brick shown in FIG. 3 has a predetermined height along the Y-axis. As can be seen, there is defined a maximum height Hmax: according to one embodiment, the total height of all bricks at any point in time must not exceed Hmax. In other words, as various actions are proposed for scheduling in the near future, the combined magnitudes of proposed bricks over time are monitored, and the corresponding bricks must be arranged to fit under Hmax. (In the embodiment, the combination of magnitudes happens to be a simple summing, but other possible ways of mathematically combining magnitudes are conceivable.) Arrangements of actions where a total height of bricks at a given time exceeds Hmax are thus effectively forbidden, and in a typical embodiment an alternative schedule of actions will then be proposed.

With reference to an example one of the A4B bricks in FIG. 3, the image-placement bricks in this embodiment include a main section a, of a predetermined height, corresponding to placement of the image on the moving photoreceptor belt; and, in addition, buffer portions b, of a different predetermined height, before and after placement of the image. The buffer portions b are manifestations of the idea that there should be a buffer, or room for variations in image placement, in the operation of the printer to place each image on the photoreceptor. The buffer portions b are not as high as the main section a, because the buffer portions will permit some overlap in time with other bricks. Although not shown in FIG. 3, the buffer b of one imaging brick can overlap with the buffer of an adjacent imaging brick, as well as any further brick, once again as long as the total height of the bricks stays under Hmax.

In a practical embodiment, the predetermined heights or magnitudes of various types of bricks will be determined by engineering tolerances of the printer hardware and software. For instance, even if it is impossible to place an image on a seam of the photoreceptor, the brick SB corresponding to the seam need not have a height all the way to Hmax, because the seam area may permit the placement of a buffer, such as in portion b of an image brick A4B, over the seam. Thus, the height of SB plus the height of a buffer portion b can be made to be not more than Hmax.

Although two types of bricks, corresponding to different types of patches, are shown, in FIG. 3, other types of bricks, with suitable heights, are possible. The types of patches will differ in, for instance, the number of necessary cycles for sufficient erasure, and also whether the patch is intended to be transferred to a print sheet. Such patches may relate to purge patches, for clearing the system of excess toner, which typically require multiple erase cycles (therefore mandating multiple erase bricks) are usually not transferred to a print sheet.

A practical advantage facilitated by the present system is the provision of ad-hoc bricks, in response to new conditions that can be introduced into the scheduling system. For example, if it is discovered that there is a scratch or other imperfection at a given point along the photoreceptor 10, a brick can be introduced that effectively precludes the scheduling of an image (such as the "a" portion of an A4B brick) over the imperfection. However, it may be allowable to have a non-imaging buffer portion of a brick (the "b" portion of an A4B brick) overlap the imperfection. Thus, a brick intended to avoid imaging on the imperfection could have a height similar to that of P2B in FIG. 3: high enough to be simultaneous with a buffer, but too high to be simultaneous with an image. Further, such an ad-hoc brick need only be long enough (along the time domain) to avoid the imperfection. Thus, if the imperfection is found, for instance, to be only one centimeter along the photoreceptor 10, the brick need only be long enough to avoid that bad centimeter. Because the brick need only be long enough to avoid the imperfection, avoidance of small imperfections may not extensively disrupt scheduling of images. (In prior-art systems, such as shown in U.S. Pat. No. 5,173,733, detected imperfections are known to cause disabling of whole page-sized image areas regardless of the size of the imperfection itself.)

While FIG. 3 shows a schedule for apportioning actions along a photoreceptor, an analogous schedule, with bricks of suitable types, can be used to schedule the action of a fuser, such as 50 in FIG. 1. In the case of a fuser, it will be desired to maintain a sufficient space between successive-sized sheets, in order to give the fuser a chance to regain a suitable fusing temperature before receiving a next sheet. The bricks in such a case can be designed to obtain the desired result.

The above-described system can further be adapted to schedule image placement and other operations in a printer having multiple photoreceptors or other imaging belts, such as in a TIPP (tightly integrated parallel printing) or TISP (tightly integrated serial printing) system. In one possible embodiment, there may be provided multiple sources of bricks, one for each belt, to populate a schedule; or two scheduling systems may operate independently (e.g., two systems such as shown in FIG. 3, operating in parallel), and then, upon each settling on a schedule up to a time-horizon, proposing an order of image placement.

The height-based constraint system described above facilitates mapping out the use of the photoreceptor to millisecond accuracy. With the above-described system, the position of the images is fully independent from a data-structure responsible for managing the photoreceptor's usage. Thus, by enabling shifting the position of the images from each other and from the seam and other imperfections, the system will naturally adapt to the new set of constraints in a predictable and reliable manner to successfully schedule image, patches, and reads on those patches.

The present system is thus distinguishable from prior-art systems, in which page-sized images are assigned to fixed frames on the photoreceptor surface, manifest in control timing of the imaging station, which corresponds to fixed areas along the photoreceptor. In those systems, the photoreceptor surface is apportioned into fixed frames that hold one or more page images: often, an overall control system is incapable of scheduling any portion of an image outside of a frame. In contrast, the present system does not constrain image placement within frames, and so, as in the case of the small imperfection, image placement along the photoreceptor can be adjusted on an essentially continuous basis.

The arrangement of bricks within a time-space to dynamically form a schedule while a machine is in operation can be carried out using a multimap data structure.

While the present disclosure is directed to a monochrome, xerographic printing apparatus, the teachings and claims herein can be readily applied to color printing apparatus, and to any rotatable imaging member such as an intermediate belt or drum as used in xerography, iconography, production inkjet, or offset printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a printing apparatus, the apparatus having a rotatable imaging member, a scheduling system, and means for performing a selected one of a plurality of operations on a portion of the rotatable imaging member, comprising:

populating a time frame of at least one image to be placed on the rotatable imaging member, wherein the time frame comprises a time and a magnitude that relates to the placement of at least one image on the rotatable imaging member;

for an operation of a first type on the rotatable imaging member in the printing apparatus, scheduling, with the scheduling system, a first action, the first action defining a time duration associated with the operation of the first type, and defining a first portion having a first magnitude and a second portion having a second magnitude where the magnitude of the first portion is different from the magnitude of the second portion;

for an operation of a second type on the rotatable imaging member in the printing apparatus, the operation of the second type being different from the operation of the first type, scheduling, with the scheduling system and before performing the first action, a second action, the second action defining at least one magnitude and a time duration associated with the operation of the second type, wherein the scheduled first action and the scheduled second action at least partially overlap in time;

monitoring a combined magnitude of actions scheduled over time; and performing the operations on a portion of the rotatable imaging member based on the scheduled actions, wherein the method further comprises forbidding a scheduling of actions resulting in a combined magnitude greater than a predetermined maximum, wherein the first portion of the first action relates to placement of an image on the imaging member, and wherein the second portion of the first action is associated with a buffer associated with the image on the imaging member.

2. The method of claim 1, the second action relating to placement of a patch on the imaging member.

3. The method of claim 2, further comprising scheduling at least one erase action, corresponding to a partially erased patch.

4. The method of claim 3, the erase action having a magnitude different from a magnitude of the second action.

5. The method of claim 1, the second action relating to presence of a seam in the imaging member.

6. The method of claim 1, further comprising:

scheduling a third action, the third action defining at least one magnitude and a time duration associated with an imperfection in the imaging member.

7. The method of claim 6, at least a portion of the third action having a magnitude effectively precluding simultaneous scheduling with a portion of another action relating to placement of an image on the imaging member.

* * * * *